US006023901A

United States Patent [19]

Jensen

[11] Patent Number: 6,023,901

[45] Date of Patent: Feb. 15, 2000

[54] SELF-DRILLING WALL REPAIR JACK

[75] Inventor: Lars Dean Jensen, Arlington, Tex.

[73] Assignee: Jensen R&D Corporation, Arlington, Tex.

[21] Appl. No.: 09/190,811

[22] Filed: Nov. 12, 1998

[51] Int. Cl.[7] ..... E02D 37/00

[52] U.S. Cl. ..... 52/514; 411/341; 411/342; 408/72 R; 408/87

[58] Field of Search ..... 52/514; 411/341, 411/342; 408/72 R, 87

[56] References Cited

U.S. PATENT DOCUMENTS

| | | |
|---|---|---|
| 1,117,662 | 11/1914 | Graham . |
| 2,638,774 | 5/1953 | Wieman . |
| 3,325,955 | 6/1967 | Haut . |
| 3,690,084 | 9/1972 | Leblanc . |
| 3,834,107 | 9/1974 | Standing . |
| 3,936,988 | 2/1976 | Miceli . |
| 4,075,809 | 2/1978 | Sirkin . |
| 4,189,891 | 2/1980 | Johnson et al. . |
| 4,193,243 | 3/1980 | Tiner . |
| 4,408,429 | 10/1983 | Neal . |
| 4,471,594 | 9/1984 | Doyle . |
| 4,601,625 | 7/1986 | Ernst et al. . |
| 4,848,056 | 7/1989 | Kelly . |
| 4,945,700 | 8/1990 | Powell . |
| 5,018,331 | 5/1991 | Foranzo . |
| 5,039,262 | 8/1991 | Giannuzzi . |
| 5,048,796 | 9/1991 | Maldonaldo . |
| 5,117,605 | 6/1992 | Walbeiser . |
| 5,160,225 | 11/1992 | Chern . |
| 5,190,425 | 3/1993 | Wieder et al. . |
| 5,199,238 | 4/1993 | Maestas . |
| 5,226,767 | 7/1993 | Foerster, Jr. . |
| 5,234,299 | 8/1993 | Giannuzzi . |
| 5,308,203 | 5/1994 | McSherry et al. . |
| 5,449,257 | 9/1995 | Giannuzzi . |
| 5,529,449 | 6/1996 | McSherry et al. . |
| 5,555,691 | 9/1996 | Nguyen . |
| 5,630,688 | 5/1997 | Tran . |
| 5,692,864 | 12/1997 | Powell et al. . |
| 5,702,218 | 12/1997 | Onofrio ..... 411/552 |
| 5,875,606 | 3/1999 | Jensen ..... 52/741.41 |

*Primary Examiner*—Christopher T. Kent
*Assistant Examiner*—Nkeisha J. Maddox

[57] ABSTRACT

A repair device which is used to restore planarity to concave damage in a drywall board, which is quickly installed by chucking to a reversible power driver in the manner of a drill bit, thus creating its own hole. The device is inserted into the wall cavity, then powered in the reverse direction to actuate in the manner of a jack to push out a damaged drywall piece, which is still hingedly attached by the cardboard facing. Thus united, the cracks are bonded with cement, while the inexpensive device remains inside the wall, acting as a permanent prop.

19 Claims, 6 Drawing Sheets

SELF-DRILLING WALL REPAIR JACK

CROSS REFERENCE

The present application is related to application Ser. No. 08/859,126, filed May 20, 1997, entitled "Wall Repair Jack," by inventor Lars D. Jensen, now U.S. Pat. No. 5,875,606 issued Mar. 2, 1999, which is not admitted to be prior art by its mention as a reference.

BACKGROUND

A typical wall is constructed of vertical studs, on whose sides drywall boards are fastened. Each drywall board is made of a thick central core of plaster, sandwiched between two cardboard facings. Finishing of the wall includes several steps such as tape and bedding, priming texturing, and painting.

The drywall board can be accidentally damaged by something being pushed into it. If the damage is severe, a piece of drywall board is dislodged, creating a hole. Heretofore, prior art has approached the repair in two ways: a) cutting out all dislodged pieces then custom fitting a new patch piece to suit, and b) backing the hole so that filler material can be trowelled in place.

Both approaches are time consuming. Cutting and fitting a new piece is iterative, laborious, and presumes that an extra piece of drywall is available. Trowelling a thick plug of filler cannot be done in one step. Overnight drying is usually required, whereupon shrinking causes cracking. Then the filling process must be repeated. Both of these approaches require extensive refinishing steps including texturing, an art requiring tools and skills most homeowners do not possess.

However, very often the damage is less severe, forming only a local depression in the planar front surface of the near drywall board. Pieces of the brittle plaster core crack and deflect inward (or rearward), while the cardboard facing tears or creases generally along the crack lines. Previously, it was not fully realized that these pieces, themselves are exact-fitting patch pieces, still hingedly attached on some edges by the cardboard facing.

Accordingly, there is a real need for a device that can exploit the advantage of restoring the wall by moving these pieces back to their original flat position. Ideally, such a device would be quickly installed in a way which minimizes the need for final surface finishing.

SUMMARY

It is an objective of the present invention to provide a wall repair jack which improves the quality of a wall repair. This objective is achieved by a device which acts to push from the inside, thus returning the damaged pieces of drywall back to their original flat position.

It is a further objective of the present invention to provide a self-drilling wall repair jack to accomplish a wall repair in less time than was possible before. This objective is achieved by comprising a drill tip to the far end of the device. By chucking the device to a typical hand drill (preferably one with selectably reversible rotation), the device can be both installed and actuated.

Another useful objective of the present invention, is to provide a device which improves the strength of a wall repair. This objective is achieved in two ways. First the edges of the cracks, exposed by their inward deflection, can be coated with cement, so that when the present invention causes the edges to intimately reunite, the bonding strength is greatly enhanced. Secondly, the inexpensive device of the present invention remains inside the wall as a permanent prop to strengthen the repair against subsequent damage.

Yet another objective of the present invention is to aid the unskilled worker in accomplishing a wall repair with a finished appearance. Accordingly, the present invention restores the original surface, reducing the final finishing tasks to: a) filling the drilled hole, b) blending the cracks, and c) painting.

Therefore, the present invention is directed to a self-drilling wall repair jack comprising a threaded rod on which a toggle is threaded, a drill pad at the far end which acts to drill a hole through a deflected drywall piece when the threaded rod is turned clockwise and where the drill pad acts as a rotating pad when the threaded rod is rotated counter-clockwise. Thus, when the near end of the present invention is chucked to a reversible drill, the user can drill a hole; stop the drill and insert the wall repair jack into the wall; and finally by reversing the direction of the drill while pulling out slightly to impress the toggle against the backside of the defected drywall piece, the wall repair jack can be actuated against the far drywall board to push the deflected drywall piece out to a flat condition.

Figure 1:
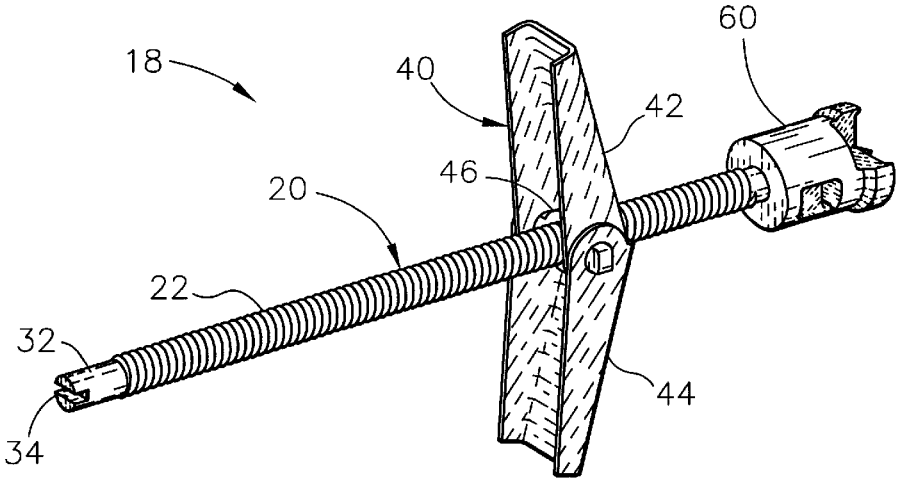
FIG. 1 is a perspective view of the preferred embodiment of the present invention.

| Reference Numerals Used in the Drawings | |
|---|---|
| 18 | self-drilling wall repair jack |
| 20 | threaded rod |
| 22 | thread |
| 24 | cylindrical far end |
| 26 | cylindrical groove |
| 28 | notch |
| 30 | flat end |
| 32 | cylindrical near end |
| 34 | slot |
| 40 | toggle |
| 42 | inner toggle wing |
| 44 | outer toggle wing |

-continued

| Reference Numerals Used in the Drawings | |
|---|---|
| 46 | pivot nut |
| 50 | plastic toggle |
| 52 | flex wing |
| 60 | drill pad |
| 62 | edge of opening |
| 64 | pawl |
| 66 | edge of first molded opening |
| 68 | edge of second molded opening |
| 70 | centering point |
| 72 | cutting tip |
| 74 | sharp cutting edge |
| 75 | arcuate edge |
| 76 | flat bottom |
| 80 | cement |
| 90 | filler |
| 100 | near drywall board |
| 102 | far drywall board |
| 103 | near surface |
| 104 | deflected drywall piece |
| 105 | hole |
| 106 | deflected drywall piece |
| 107 | hole |
| 107a | edge of the hole |
| 108 | deflected drywall piece |
| 109 | hole |
| 110 | deflected drywall piece |
| 111 | hole |
| 112 | restored drywall piece |
| 113 | hole |
| 114 | restored drywall piece |
| 115 | hole |
| 200 | chuck |
| 202 | clockwise rotation direction |
| 204 | inserting direction |
| 206 | backward direction |
| 208 | counterclockwise rotation direction |
| 300 | screwdriver |

DESCRIPTION

Throughout the following descriptions the term "near" is meant as being near the user, or on that side of the wall with the concave damage, and "far" is meant to be in the direction away from the user and toward the unseen second wallboard. When the present invention is inserted through the drilled hole, the "near" end would be sticking out of the hole, and the "far" end would be the end deepest into the wall cavity. The clockwise direction is taken as viewed by the user looking at the near end of the invention.

An overview of the preferred embodiment of the present invention is shown in FIG. 1 as a self-drilling wall repair jack 18. A threaded rod 20 has a left-handed thread 22. There is a cylindrical near end 32 in which there is a slot 34. Other features of the threaded rod can be seen in FIG. 2 as a cylindrical far end 24, in which there is a cylindrical groove 26, in which there is a notch 28. There is a flat end 30.

Again referring to FIG. 1, there is a toggle 40 which is threadably engaged on the threaded rod 20. The toggle comprises an inner wing 42 fitted to an outer wing 44 around a pivot nut 46. There is a torsion spring unseen in this view which urges the wings to open. This toggle is conventional, except that the threaded opening in the pivot nut is left-handed so as to mate with the left-handed thread 22 of the threaded rod. Thus counterclockwise rotation of the threaded rod causes a toggle restrained from rotation to move in a direction away from the far end. There is a drill pad 60 rotatably fixed on the far end of the threaded rod.

Figure 2:
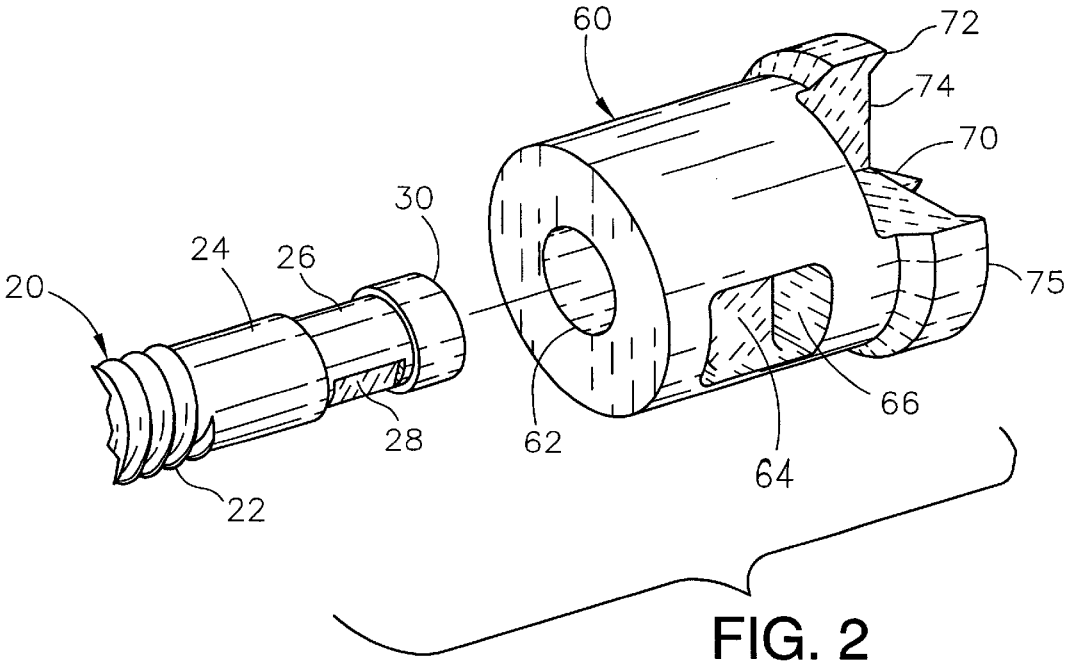
FIG. 2 is an exploded partial view of the present invention showing features on the end of the threaded rod which were concealed in FIG. 1.

Now referring to FIG. 2, additional features of the drill pad 60 can be seen as an edge of opening 62 which is sized to receive the cylindrical far end 24. There is a pawl 64 which is a molded feature inside a first molded opening edge 66. There are rotary cutting means at the far end of the drill pad which are designed to cut and remove material in the manner of drilling a hole into a drywall board during rotary movement. The features shown comprise a centering point 70, one or more of a cutting tip 72 and one or more of a sharp cutting edge 74. There is one or more of an arcuate edge 75. The centering point is shown having a conical shape, however it could also be pyramidal, having facets with edge scrapers, which are edges acting to scrape. Other means of rotary cutting could be utilized having such well-known elements as saw teeth, blades, spades, serrations and the like which drill, cut, saw, trepan, scrape, scribe, gouge, or shear a hole through the drywall board.

Figure 3:
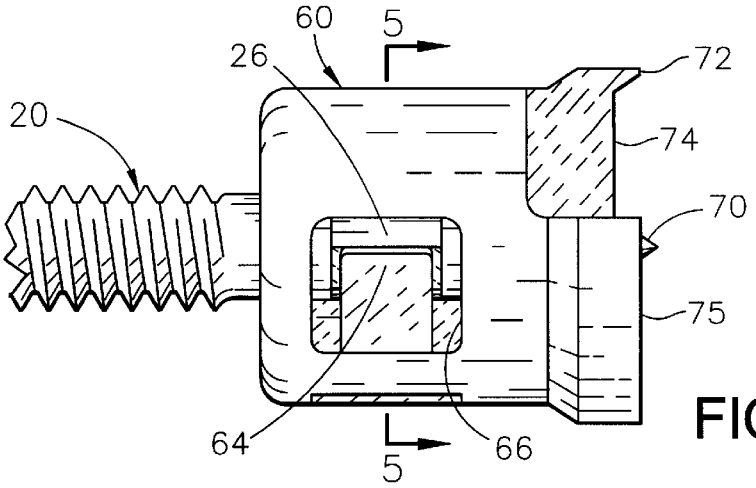
FIG. 3 is a partial elevational view of the drill pad.
Figure 4:
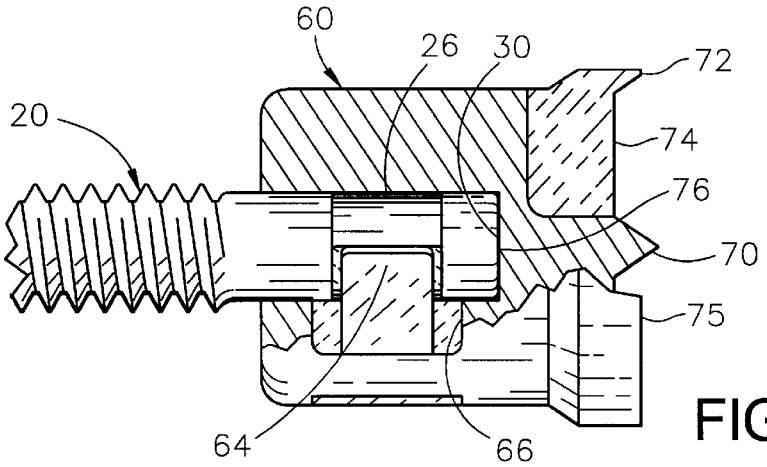
FIG. 4 is a partial sectional view of the drill pad.

FIG. 3 shows a side elevation of the drill pad 60 where the pawl 64 can be seen aligning with and fitting into the cylindrical groove 26 of the threaded rod 20. In this way, the pawl acts to retain the drill pad from becoming loose from the threaded rod while also permitting rotation. Therefore, the drill pad is rotatably fixed to the far end of the threaded rod. FIG. 4 shows a partial section of a view similar to FIG. 3 where the flat end 30 of the threaded rod is against a flat bottom 76 of the drill pad, thus providing a thrust bearing, especially when a force is exerted against a stationary drill pad while the threaded rod is powered to turn.

Figure 5:
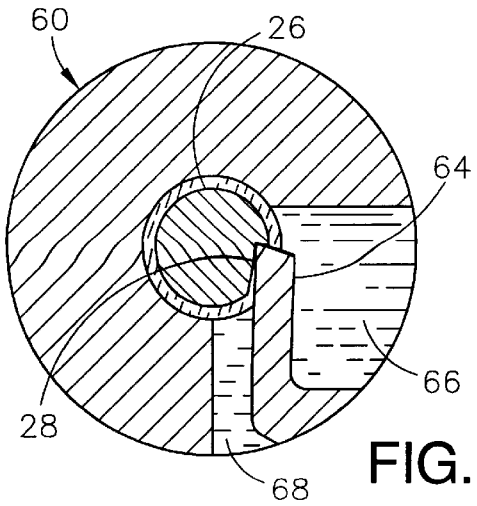
FIG. 5 is a sectional view taken along cutting plane 5—5 in FIG. 3.

The drill pad 60 can be made of plastic, which is inexpensive and by the process of injection molding, which offers complex shaping. FIG. 5 is a sectional view taken along cutting plane 5—5 in FIG. 3 showing the pawl as being integrally molded as a cantilever member, elastically flexing within the edge of first molded opening 66 and bounded also by an edge of a second molded opening 68. The pawl is bent back (toward the right in this view) from its free position to engage with the notch 28 so that there is a bias force urging the pawl into the notch. Now it can be appreciated that if the threaded rod is powered to rotate clockwise, then the notch engages the pawl, thus forcing the drill pad to rotate in unison with the threaded rod. This means that the present invention can be chucked into a typical hand drill motor and utilized in a familiar fashion as a drill bit.

Figure 6:
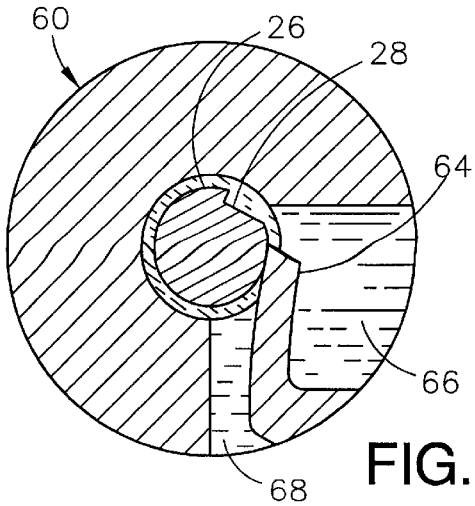
FIG. 6 is a sectional view similar to FIG. 5, but where the notch is shown rotated counterclockwise.

Now refer to FIG. 6, which is similar to FIG. 5, except that the threaded rod 20 is shown having rotated counterclockwise. The notch 28 is free to turn away from the pawl and even pass under it repeatedly, thus offering unlimited counterclockwise rotation. The pawl may make a slight clicking sound as it snaps into the notch once every rotation. The action of the notch with the pawl is known generally by those experienced in the art as a "one-way clutch means." There are other ways the present invention can provide this action. For example, a separate pawl member, pivoting on a shaft, urged by a spring could be used. Also known in the art, is a rotary arrangement of dogs whose engagement lengthens when tilted. This causes a binding action which locks-up in one rotation direction, but freewheels in the opposite. These and other one-way clutch means are considered to be within the scope of what will later be claimed of the present invention.

Therefore, the drill pad 60 acts at times (when powered clockwise) like a cutting drill and at other times (when powered counterclockwise) as a thrust bearing rotatable pad. The advantages of providing a one-way clutch means will be better appreciated by viewing the following figures, which show the step-by-step operation of the present invention.

Figure 7:
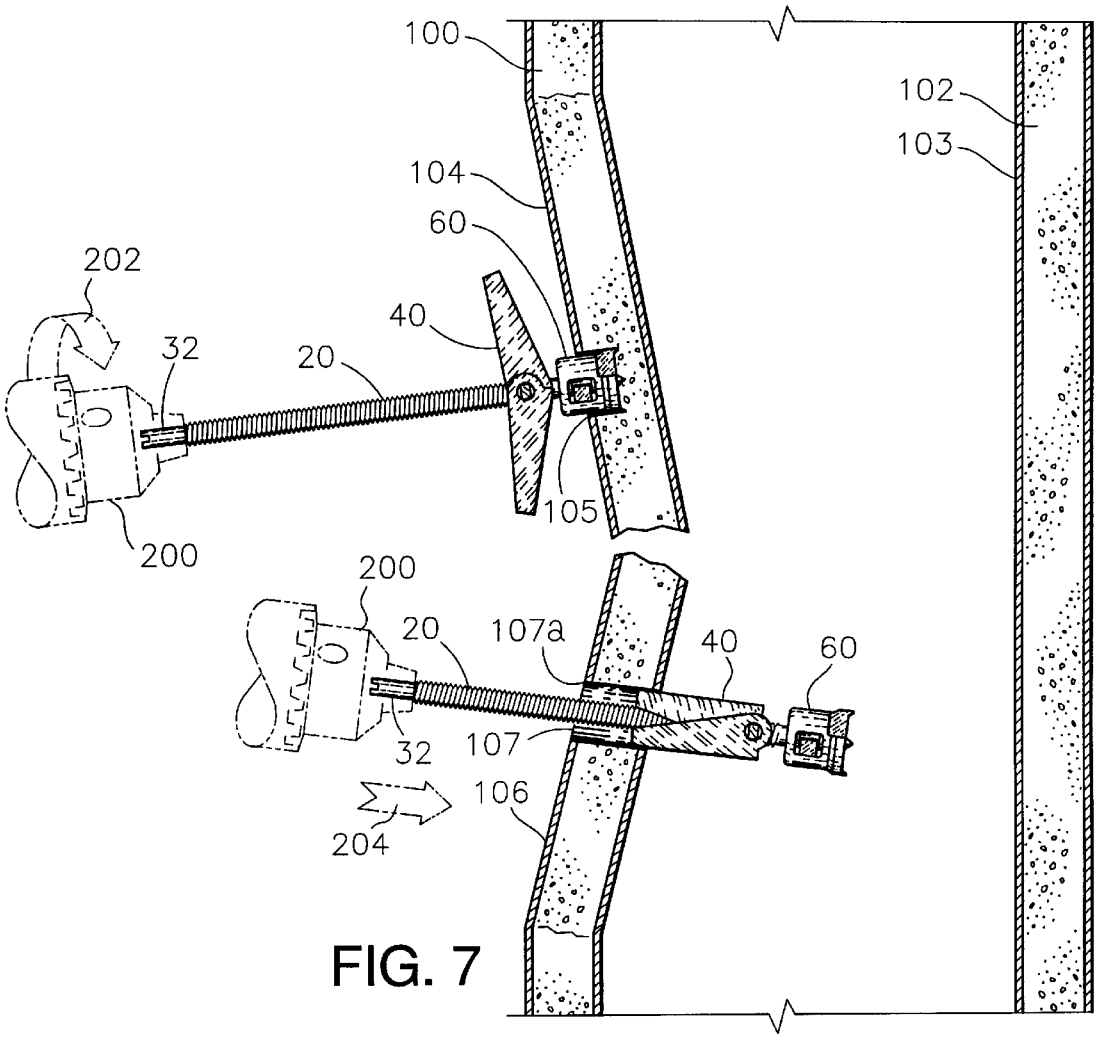
FIG. 7 is a sectional view through a damaged wall showing the side elevations of the present invention in two positions: while drilling into the wall, and while being inserted through the drilled hole.

FIG. 7 shows a section though a typical wall constructed of near drywall board 100 having a substantially planar front surface, and far drywall board 102. There is a vertical stud (which is not shown) which separates the two boards by a distance (typically of 3½ inches.) There is damage in the form of a depression to the near drywall board comprising a deflected drywall piece 104 and a deflected drywall piece 106, each of which is shown deflected rearwardly. The upper part of FIG. 7 shows a chuck 200 of a conventional reversible drill motor (not shown) which has been coupled to the cylindrical near end 32 of the present invention and which is driving the present invention in a clockwise rotation direction shown by the arrow noted by reference numeral 202. All parts of the present invention are turning in unison and the drill pad is shown cutting a hole 105 into the deflected drywall piece 104.

The lower portion of FIG. 7 shows the present invention after a hole 107 has been fully drilled through the deflected drywall piece 106, and the chuck 200 has stopped turning and where the chuck has pushed, collapsed, and inserted the toggle 40 of the present invention into the hole in the inserting direction noted by reference numeral 204. The toggle was forced into a closed position by the inner toggle wing 42 and the outer toggle wing 44 striking against the edge of the hole 107*a*.

Figure 8:
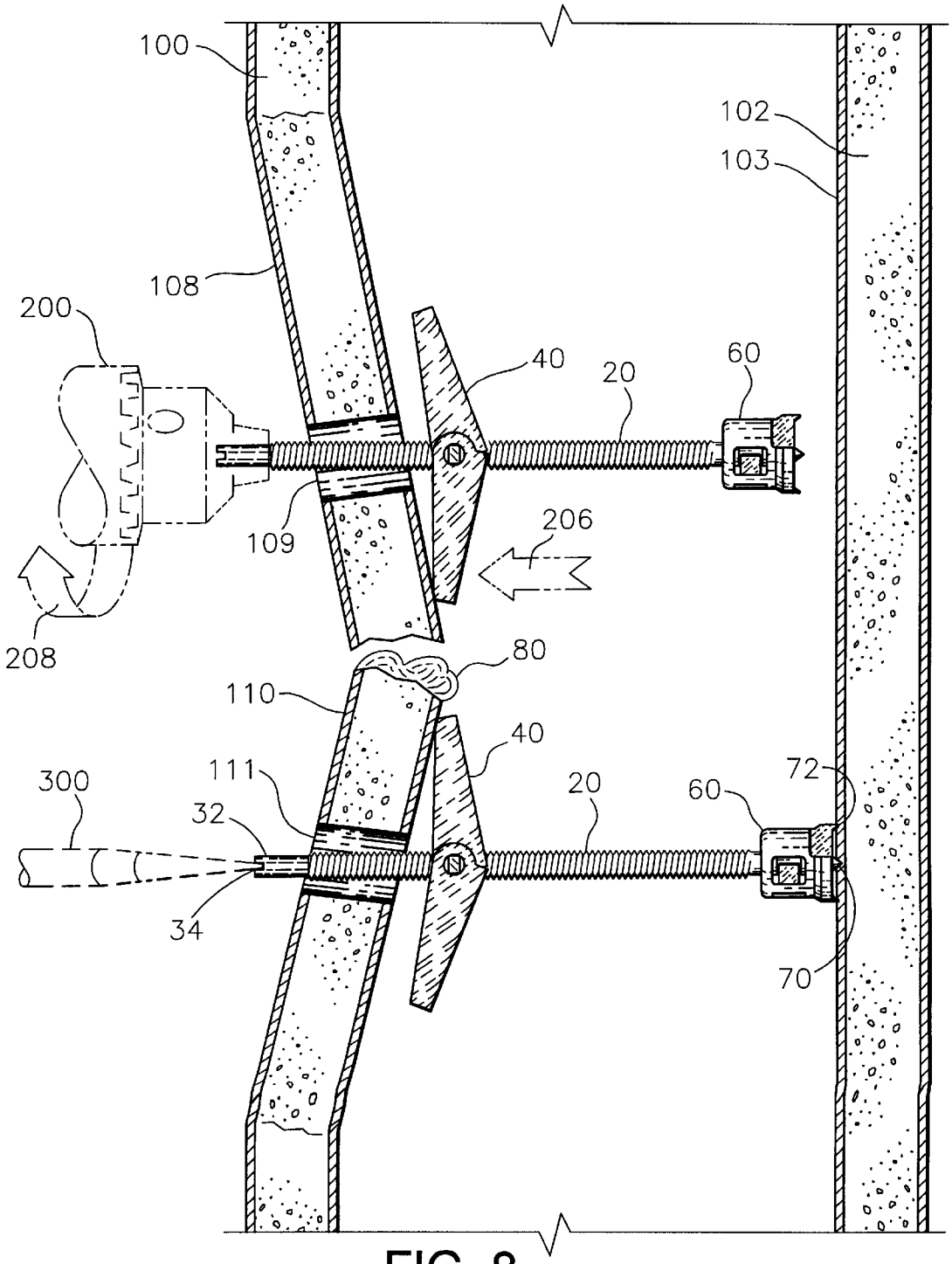
FIG. 8 is a sectional view though a damaged wall showing the side elevations of the present invention in two positions: with the toggle expanded and threaded rod advancing, and while making fine adjustments with a screwdriver.

Continuing with the operation of the present invention, FIG. 8 shows a similarly damaged wall with a deflected drywall piece 108 and a deflected drywall piece 110, having drilled holes 109 and 111 respectively. The upper portion of FIG. 8 shows the preferred embodiment of the present invention inserted far enough so that the toggle 40 has re-expanded to an open position. The chuck 200 has been moved in a backward direction shown by the arrow noted by reference numeral 206, so that the toggle is restrained from turning by impinging against the far side of the deflected drywall piece 108. The chuck is also driving the preferred embodiment of the present invention in a counter-clockwise rotation direction shown by the arrow noted by reference numeral 208. The result of these actions is that the drill pad 60 is moving in a direction toward the far drywall board 102.

When the drill pad 60 (which is now unseen by the user) ultimately makes contact with the near surface 103 of the far drywall board 102, the user is alerted by noticing any of four changes: 1) a higher reaction torque felt by the hand holding the drill motor, 2) a change in frequency of the sound of the drill motor as its rotation rate slows, 3) an outward movement of the deflected drywall piece 108, or 4) a clicking sound created by the pawl 64 of the now stationary drill pad.

Now additional rotations (or clicks) will cause the present invention to lodge itself between the deflected drywall piece and the far drywall board, sufficiently to hold itself in place, without falling down inside the wall. Certain features, such as the arcuate edge 75, of the drill pad 60 act to provide a support surface for supporting a force imposed by the drill pad against the far drywall board, other supporting features include the centering point 70 and each cutting tip 72, each of which also acts like a "sticking point" to indent into the near surface of the far drywall board, thus reducing the likelihood of falling. In this regard, the center pointing and each cutting tip serve a second function, namely to secure the drill pad against lateral movement. Other sticking points may be added whose dedicated function is to stick rather than to cut.

Now, when the present invention is actuated, it creates an "equal and opposite force" between the deflected drywall piece and the far drywall board, which is useful to purposely cause the deflected drywall piece to move in a direction away from the far drywall board, and to restore the original flat surface of the near drywall board.

However, at this time, rather than actuating the deflected drywall piece further, the user is advised to stop and uncouple the powered driver. This is to assess whether the degree of wall damage calls for additional devices (according to the present invention) to be similarly installed behind other deflected drywall pieces. Once this is done, each cylindrical near end 32 is seen extending from each drilled hole. Each has a slot 34 which can now be coupled with a manual driver such as screwdriver 300 in a manner as shown in the lower portion of FIG. 8.

Since some of the deflected drywall pieces may be connected to one another by the cardboard facing, if the user actuates only one device (according to the present invention) then an adjacent drywall piece may also move, perhaps causing the adjacent device to loosen and fall. For this reason, each of the devices should be turned a small amount, in a sequential fashion, where the user moves the screwdriver from one device to another. The user must also judge and provide more turns to those devices whose defected drywall piece is initially deeper into the wall.

Figure 9:
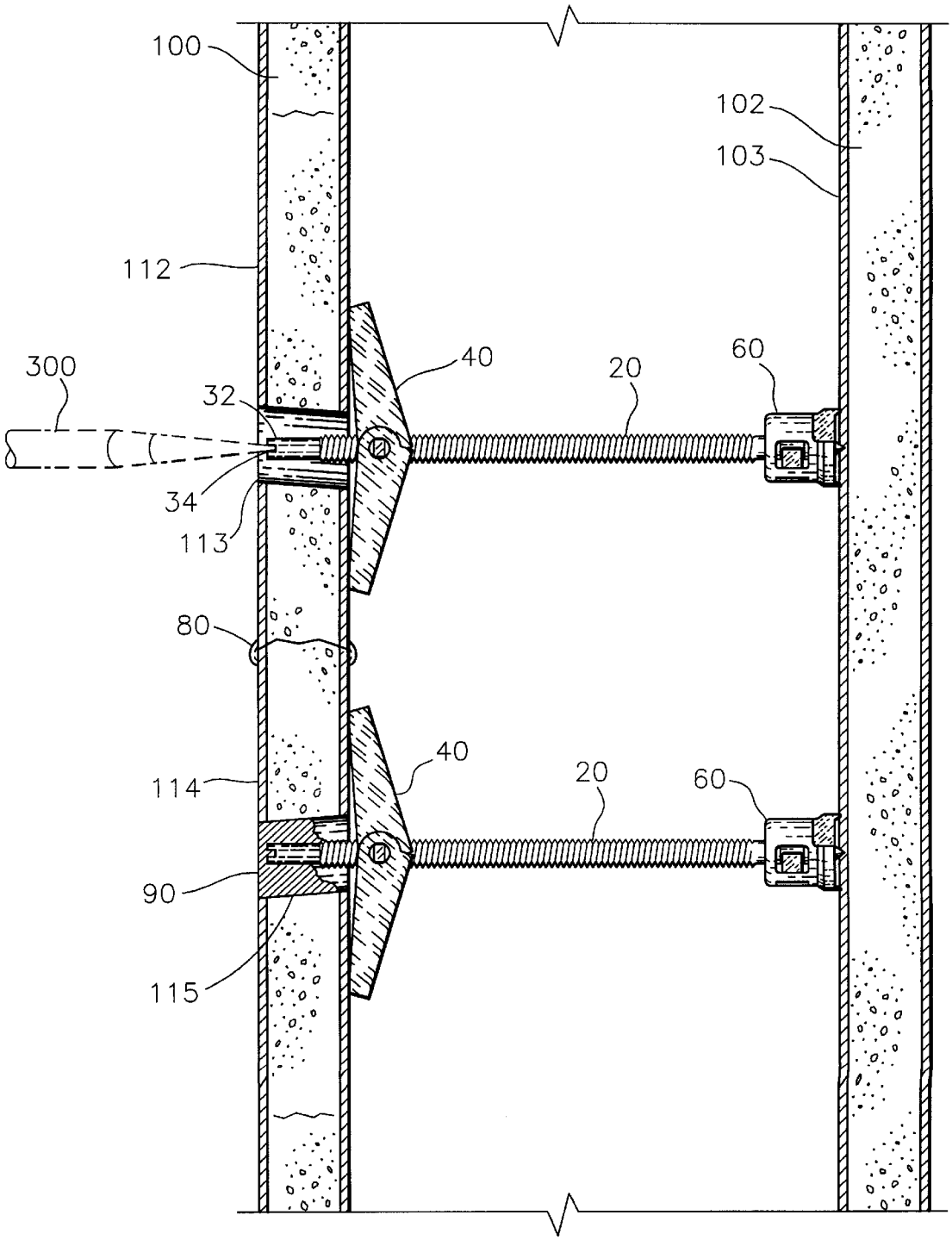
FIG. 9 is a sectional view through a repaired wall showing the side elevations of the present invention in two positions: after repairing the wall flat, and after filling the hole.

Now it is advantageous, just prior to sequentially actuating the devices (according to the present invention), for the user to apply a cement 80, preferably using a nozzle tip dispenser into every exposed tear and crack. Without delay, the user then sequentially actuates by turning each of the slots 34 counterclockwise to bring each of the deflected drywall pieces back into flat alignment with the surrounding wall FIG. 9 shows a repaired wall having a restored drywall piece 112 and a restored drywall piece 114, having drilled holes 113 and 115 respectively. Notice that where before edges of deflected drywall pieces were apart, now they have been united, giving opportunity for the cement 80 to bond. The present invention has been designed to a length such that no portion of the present invention extends forward of the exterior front surface plane of the wall. The present invention shown in the lower portion has been concealed by a filler material 90 filling in and smoothing flat over the hole 115. Thus restored to a flat condition, the user finishes the repair by patching and blending the cracks, and finally by repainting.

A unique method of using the present invention, which demonstrates its versatility, is to insert the present invention from the rear through a hole in the far wall. One advantage to this method, would be in the case where the damaged near wall is covered with decorative wallpaper.

Figure 10:
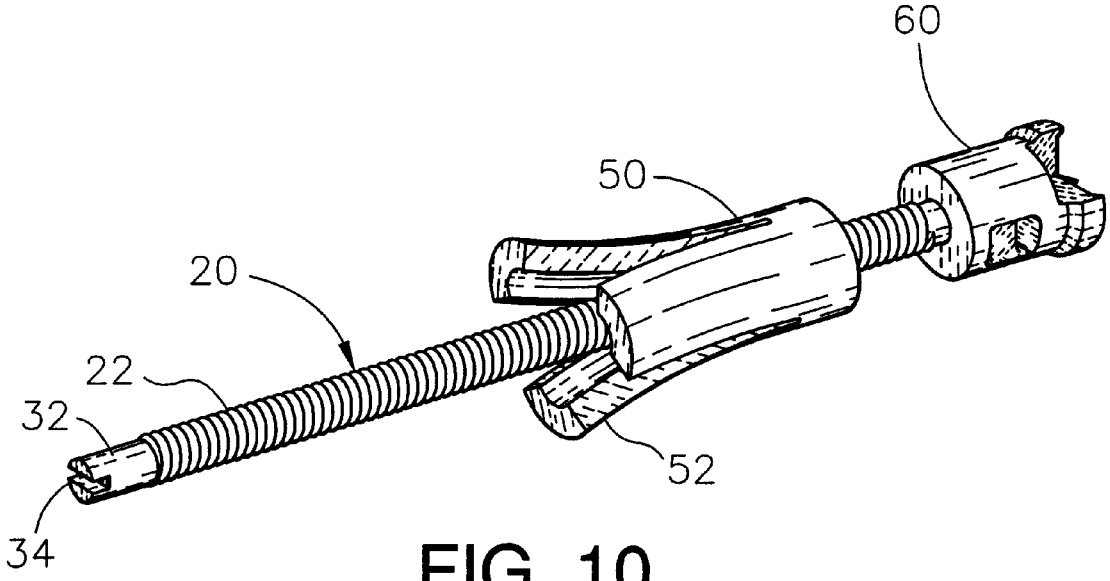
FIG. 10 is a perspective view of an alternate embodiment of the present invention comprising a plastic toggle.

FIG. 10 shows an alternate embodiment of the present invention in which the conventional toggle 40 has been replaced with a plastic toggle 50 which is a cylindrically shaped member having one or more of a flex wing 52. There is a threaded hole which cannot be seen in this view, which threadably engages with the thread 22 on the threaded rod 20. Each flex wing acts to elastically flex to a closed position when being inserted though a drilled hole, but to spring back to the open position when released. One advantage to this embodiment of the present invention is that the plastic toggle may be less expensive to fabricate. This embodiment of the present invention is operated in the same way as was shown of the preferred embodiment in FIGS. 7 through 9. Both the toggle 40 and the plastic toggle 50 are more generally defined as "expandable means." The present invention may also comprise other expandable means, such as pivoting bars, wedge action devices, umbrellas and the like.

The present invention would work equally well by replacing the near cylindrical end 32 with a different shape, such as one having square or hexagonal flats for coupling with any powered driving tool means such as a power wrench or an air motor. The present invention would work equally well by replacing the slot 34 with a recess to receive a phillips type screwdriver, or hex socket to receive an allen key, or star socket, or other well known manual driving tool means. Drilling, inserting, and actuating the present invention could be done entirely by using a power driver, or entirely by using a manual driver.

The preferred embodiment of the present invention shows the threaded rod 20 having a left-handed helical thread 22. Thus, when a hole is drilled, the drill turns with the familiar and conventional right-hand rotation. However a version of the present invention in which the threaded rod has a right-hand thread, and in which the direction of the pawl 64 and the notch 28 is reversed, would work equally well, although the user would need special instruction to assure left-handed drilling. Therefore, more generally, the operation of the present invention can be described using the terms "drilling rotation direction" and "actuation rotation direction" Then, the drilling rotation direction is that rotation direction wherein the drill pad unites (by means of the one-way clutch) with the threaded rod or that rotation direction in which the cutting features on the drill pad cut best. Conversely, the actuation rotation direction is that rotation direction which causes the drill pad to move toward the far drywall board when the expandable means is restrained from turning, or is that rotation direction which is freely allowed by the one-way clutch means, when the drill pad is restrained from rotating.

Although the present invention has been described with respect to the specific embodiments illustrated, it is understood that the present invention could be put to good use repairing any twin wall structure, such as hollow core doors, partitions, and other like building structures. These and other modifications are deemed within the spirit and scope of the following claims.

What is claimed is:

1. A device for use in repairing a depression in a drywall board, wherein the drywall board has a substantially planar front surface surrounding the depression, and wherein the depression comprises a deflected drywall piece which is deflected rearwardly out of the planar front surface, said device comprising:

a) a threaded rod having a near end and having a far end;

b) a drill pad, having a rotary cutting means for creating a hole in the deflected drywall piece if the drill pad were to be impressed against the deflected drywall piece and rotated in a drilling rotation direction, said drill pad rotatably fixed to the far end of the threaded rod;

c) a one-way clutch means for one-way clutching continuous rotation in only one direction such that:

if the threaded rod is rotated in the drilling rotation direction, then said one-way clutch means unites the drill pad with the threaded rod, causing it to turn in unison with the threaded rod; and such that if the threaded rod is turned in an actuation rotation direction and the drill pad is restrained from turning, then said one-way clutch means permits the threaded rod to turn freely; and d) an expandable means for expanding, which at times assumes a closed position having a size which would pass through the hole, and when released expands to an open position having a size which would not pass through the hole, said expandable means threadably engaged with the threaded rod, wherein if the threaded rod is rotated in the actuation rotation direction and the expandable means is restrained from turning, then said expandable means moves in a direction away from the far end of the threaded rod.

2. The device of claim 1, which additionally comprises a coupling means for coupling with a powered driving tool at the near end of the threaded rod.

3. The device of claim 1, which additionally comprises a coupling means for coupling with a manual driving tool at the near end of the threaded rod.

4. The device of claim 1, wherein the expandable means comprises a toggle.

5. The device of claim 1, wherein the expandable means comprises a cylindrically-shaped member having one or more of a flex wing which elastically flexes.

6. The device of claim 1, wherein the one-way clutch means comprises a pawl, which is an elastically-flexing member integral with the drill pad.

7. The device of claim 1, wherein the rotary cutting means comprises a centering point.

8. The device of claim 1, wherein the centering point comprises one or more of an edge scraper.

9. The device of claim 1, wherein the rotary cutting means comprises one or more of a cutting tip.

10. The device of claim 1, wherein the rotary cutting means comprises one or more of a sharp cutting edge.

11. A self-drilling wall repair jack for use in moving a deflected drywall piece which is out of plane with a surrounding near drywall board, and for applying an equal and opposite force between the deflected drywall piece and a far drywall board, said self-drilling wall repair jack comprising:

a) a threaded rod having a near end and having a far end;

b) a drill pad, rotatably fixed to the far end of the threaded rod, comprising:

a rotary cutting means for creating a hole in the deflected drywall piece, a one-way clutch means for one-way clutching continuous rotation in only one direction, such that if the threaded rod is rotated in a drilling rotation direction, then said one-way clutch means unites the drill pad with the threaded rod, causing it to turn in unison with the threaded rod, and such that if the threaded rod is turned in an actuation rotation direction and the drill pad is restrained from turning, then said one-way clutch means permits the threaded rod to turn freely, and a support surface for supporting a force imposed by the drill pad if it were to be impressed against the far drywall board; and c) an expandable means for expanding, which at times assumes a closed position having a size which would pass through the hole, and when released expands to an open position having a size which would not pass through the hole, said expandable means threadably engaged with the threaded rod, wherein if the threaded rod is rotated in the actuation rotation direction and the expandable means is restrained from turning, then said expandable means moves in a direction away from the far end of the threaded rod, whereby:

if the drill pad is impressed against the deflected piece of drywall and the threaded rod is turned in the drilling rotation direction, then the self-drilling wall repair jack creates the hole; and whereby if the self-drilling wall repair jack is inserted into the hole, then the edge of the hole forces the expandable means to assume a closed position; and whereby if the self-drilling wall repair jack is inserted through the hole to a position where the expandable means is not inside the hole, then the expandable means expands to the open position; and whereby if the threaded rod is turned in the actuation rotation direction and the expandable means is restrained from turning by being pulled back in contact with a far side of the deflected drywall piece, then the threaded rod and the drill pad move in a direction toward the far drywall board; and whereby if the support surface is impressed against a near side of the far drywall board and the expandable means is impressed against the far side of the deflected drywall piece and the threaded rod is turned in the actuation rotation direction, then the deflected drywall piece is caused to move in a direction away from the far drywall board.

12. The self-drilling wall repair jack of claim 11, which additionally comprises a coupling means at the near end of the threaded rod for coupling with a driving tool.

13. The self-drilling wall repair jack of claim 11, wherein the expandable means comprises a toggle.

14. The self-drilling wall repair jack of claim 11, wherein the one-way clutch means comprises a pawl.

15. The self-drilling wall repair jack of claim 11, wherein the rotary cutting means comprises a center point.

16. The self-drilling wall repair jack of claim 11, wherein the rotary cutting means comprises one or more of a cutting tip.

17. The self-drilling wall repair jack of claim 11, wherein the rotary cutting means comprises one or more of a sharp cutting edge.

18. The self-drilling wall repair jack of claim 11, wherein the support surface is bounded by one or more of an arcuate edge for securing said jack against lateral movement if the support surface were to be impressed against the near side of the far drywall board.

19. The self-drilling wall repair jack of claim 11, wherein the support surface comprises one or more of a sticking point for securing said jack against lateral movement if the support surface were to be impressed against the near side of the far drywall board.

* * * * *